US009761372B2

(12) United States Patent
Habraken

(10) Patent No.: US 9,761,372 B2
(45) Date of Patent: Sep. 12, 2017

(54) WIRELESS POWER CONNECTOR AND WIRELESS POWER CONNECTOR SYSTEM

(71) Applicant: TYCO ELECTRONICS NEDERLAND BV, S-hertogenbosch (NL)

(72) Inventor: Gied Habraken, Valkenswaard (NL)

(73) Assignee: TE Connectivity Nederland B.V., S'Hertogenbosch (NL)

( * ) Notice: Subject to any disclaimer, the term of this patent is extended or adjusted under 35 U.S.C. 154(b) by 367 days.

(21) Appl. No.: 14/380,066

(22) PCT Filed: Feb. 21, 2013

(86) PCT No.: PCT/EP2013/053466
§ 371 (c)(1),
(2) Date: Aug. 20, 2014

(87) PCT Pub. No.: WO2013/124359
PCT Pub. Date: Aug. 29, 2013

(65) Prior Publication Data

US 2016/0111207 A1 Apr. 21, 2016

(30) Foreign Application Priority Data

Feb. 23, 2012 (EP) ..... 12156693

(51) Int. Cl.
*H01F 38/14* (2006.01)
*H01F 27/24* (2006.01)
*H01F 27/28* (2006.01)

(52) U.S. Cl.
CPC ..... *H01F 38/14* (2013.01); *H01F 27/24* (2013.01); *H01F 27/2823* (2013.01)

(58) Field of Classification Search
CPC ..... H01F 38/14; H01F 27/2823; H01F 27/24
See application file for complete search history.

(56) References Cited

U.S. PATENT DOCUMENTS 5,463,303 A 10/1995 Hall et al.
5,539,296 A 7/1996 Ito
(Continued)

FOREIGN PATENT DOCUMENTS

EP 0552737 A1 7/1993
EP 0653766 A1 5/1995
(Continued)

OTHER PUBLICATIONS

European Search Report issued by the European Patent Office (Munich), dated Aug. 24, 2012, for European Patent Application No. EP 12156693.9; 6 pages.

*Primary Examiner* — Jared Fureman
*Assistant Examiner* — James Evans
(74) *Attorney, Agent, or Firm* — Faegre Baker Daniels LLP

(57) ABSTRACT

The invention relates to a wireless power connector and a wireless power connector system including at least one wireless power connector for contactlessly receiving electric power from a second connector and for contactlessly supplying electric power to a third connector. In order to enable the wireless power connector to inductively forward electric power received from the second connector, the invention suggests providing a first and a second mating end respectively connectable to the second and the third connector and a magnetic core extending between the first and the second mating end. A coil is wound around the magnetic core and configured to output, as an alternating current, at least parts of the electric power received from the second connector. The magnetic core interconnects the first and the second mating end such that, in a connected state, the magnetic core inductively forwards electric power to the third connector.

15 Claims, 5 Drawing Sheets

(56) References Cited

U.S. PATENT DOCUMENTS

| | | | | |
|---|---|---|---|---|
| 8,264,369 | B2 * | 9/2012 | Hall | E21B 17/003 340/854.8 |
| 2002/0193004 | A1 * | 12/2002 | Boyle | E21B 17/028 439/577 |
| 2011/0018359 | A1 | 1/2011 | Wada et al. | |
| 2012/0007439 | A1 | 1/2012 | Kozakai et al. | |

FOREIGN PATENT DOCUMENTS

| | | | |
|---|---|---|---|
| EP | 2364873 | A1 | 9/2011 |
| JP | 2002280241 | A | 9/2002 |

* cited by examiner

WIRELESS POWER CONNECTOR AND WIRELESS POWER CONNECTOR SYSTEM

BACKGROUND

The invention relates to a wireless power connector for contactlessly receiving electric power from a second connector and for contactlessly supplying electric power to a third connector. In particular, the invention provides a wireless power connector and a wireless power connector system including the wireless power connector with a first and a second mating end, a magnetic core, and a coil wound around the magnetic core, wherein the magnetic core is arranged between the first and the second mating end such that it inductively forwards a least parts of received electric power.

Generally, the invention relates to wireless power connectors for contactless power transmission. Wireless power connectors are widely utilized for their various advantages over conventional power connectors, namely for e.g. a higher resistance to contact failures, an unlimited number of mating cycles, a low wear and tear, prevention from electric shocks, sparks and current leaks and their operability under hostile environmental influences.

Specifically, wireless power connectors may be used in industrial devices requiring the connectors to be operable under hostile environments, to resist a high amount of wear and tear during the mating cycles or may be used for power transmission in explosive or combustible environments.

A cross-section of an exemplary conventional wireless power connector system 4000 is shown in FIG. 4. The wireless power connector system 4000 includes a transmitting connector 4200 and a receiving connector 4300.

The transmitting connector 4200 is configured to contactless supply electric power to a connected receiving connector 4300. For this purpose, the transmitting connector 4200 includes a magnetic core 4210 and a coil 4220 wound around the magnetic core 4210. The coil 4220 serves as an electric power input for inputting an alternating current. In particular, the magnetic core 4210 of the transmitting connector 4220 is provided in a U-shape with the coil 4220 wound around the middle section of the magnetic core 4210.

The receiving connector 4300 is similar to the transmitting connector 4200. Specifically, the receiving connector 4300 is configured to contactlessly receive electric power from a connected transmitting connector 4200. For this purpose, the receiving connector 4300 includes a magnetic core 4310 and a coil 4320 wound around the magnetic core 4310. The coil 4320 serves as an electric power output for outputting an alternating current. In particular, the magnetic core 4310 of the receiving connector 4320 is also provided in a U-shape with the coil 4320 wound around the middle section of the magnetic core 4310.

This particular configuration of the wireless power connector system 4000 allows for highly efficient transmission of electrical power between the transmitting connector 4200 and the receiving connector 4300 since, in the mated state, the magnetic core 4210 of the transmitting connector 4200 and the magnetic core 4310 of the receiving connector 4300 form a closed magnetic loop.

However, the configuration of the wireless power connector system 4000 does not allow flexible up-scaling since the high efficiency is connected to a close magnetic coupling between the transmitting connector 4200 and the receiving connector 4300. In other words, this wireless power connector system does require a 1:1 relationship between transmitting connectors 4200 and receiving connector 4300. Put it differently, for supplying electric power to a receiving connector 4300, there is always a transmitting connector 4200 required, and the transmitting connector 4200 of the wireless power connector system 4000 cannot supply more than one receiving connector 4300.

SUMMARY

The object underlying the invention is to propose a wireless power connector system which allows for a more flexible configuration between transmitting connectors and receiving connectors, namely a system which allows for supplying electric power from at least one transmitting connector to a plurality of receiving connectors.

This object is solved by the subject matter of the independent claims. Advantageous embodiments are subject to the dependent claims.

According to a first aspect of the invention a wireless power connector (named first type wireless power connector in the following description) is provided, which can contactlessly receive electric power from a transmitting connector (named second type wireless power connector) and at the same time can forward some of the received electric power to a receiving connector (named third type wireless power connector).

To achieve high transmission efficiency, the energy is inductively forwarded to the receiving connector without requiring back and forth energy conversions, namely between a magnetic flux that has been contactlessly received from the transmitting connector, the alternating current output by a coil of the wireless power connector and a magnetic flux to be contactlessly transmitted to the receiving connector.

For this purpose, the wireless power connector according to the invention includes a magnetic coil extending between a first and a second mating end of the wireless power connector, the first and second mating end are respectively connectable to the transmitting and receiving connector.

Additionally, the wireless power connector includes a coil wound around the magnetic core of the wireless power connector and serving as an electric power output for outputting at least parts of the electric power contactlessly received from the transmitting connector. The coil outputs contactlessly received electric power as an alternating current.

Specifically, the magnetic core is arranged within the wireless power connector so as to directly interconnect the first and the second mating ends. By directly interconnecting the mating ends of the wireless power connector, the magnetic core inductively forwards at least parts of the electric power received from the transmitting connector to the receiving connector.

In the invention, a contactless reception and/or contactless supply of electric power refers to a transferral of electric power without an electrical contact (i.e. without an electric wire in-between), namely by way of electromagnetic induction. Further, the wireless power connector of the invention may also be referred to as contactless power coupler or as inductively coupled power connector.

Furthermore, in the invention a connection between the wireless power connector and the second type and/or the third type wireless power connector does not necessarily imply a direct mechanical coupling between the connectors (i.e. via an engagement mechanism) but may also refer to a connection via a separate structural member ensuring the alignment between the mating ends of the wireless power connector and the respective second type and/or third type wireless power connectors.

According to an advantageous embodiment of the invention which can be used in addition or alternatively to the above, the magnetic core includes two legs respectively interconnecting first and second regions of the first and the second mating end.

Advantageously, the first and second legs of the magnetic core of the wireless power connector allow for carrying magnetic flux in two opposing directions so as to allow for a closed magnetic circuit.

According to an advantageous embodiment of the invention which can be used in addition or alternatively to the above, the magnetic core includes a first, cylindrical leg 1111 and a second, C-shaped or O-shaped leg 1112 at least partially surrounding the first leg, and the coil is wound around the first leg.

Advantageously, the arrangement of the first, cylindrical leg surrounded by the second, C-shaped or O-shaped leg of the magnetic core of the wireless power connector allows for a rotational symmetric arrangement of the first and the second regions at the first and the second mating ends so as to allow for rotation between the wireless power connector with respect to a connected second type and/or a third type wireless power connector along a longitudinal rotation axis.

According to an advantageous embodiment of the invention which can be used in addition or alternatively to the above, the first, centre leg of the magnetic core is hollow.

Advantageously, the hollow centre leg of the magnetic core of the wireless power connector allows for an arrangement of the wireless power connector around a shaft (e.g. drive shaft).

According to an advantageous embodiment of the invention which can be used in addition or alternatively to the above, the magnetic core extends between the surfaces of the first and the second mating end, and, preferably, the magnetic core includes exposed surface areas at the first and the second mating end of the wireless power connector.

According to an advantageous embodiment of the invention which can be used in addition or alternatively to the above, wherein the second mating end is connectable to a terminating element 3400 including a magnetic core.

According to an advantageous embodiment of the invention which can be used in addition or alternatively to the above, the first and/or second mating end(s) allow for a rotatable connection to the second and the third connector.

Advantageously, the rotatable connection structure of the wireless power connector not only dispenses with the need for an alignment between the wireless power connector and the respective second and/or third connector but also allows the wireless power connector to rotate in the connected state with respect to the second and third connector. During rotation, the wireless power connector may proceed to contactlessly receive electric power from the second connector and proceed to contactlessly supply electric power to a third connector (1300) without losses in efficiency.

According to an advantageous embodiment of the invention which can be used in addition or alternatively to the above, the first and/or second mating end(s) allow for mating with only the respective second and/or third connector, or the first and second mating ends allow for mating with any of the respective second and third connectors.

According to an advantageous embodiment of the invention which can be used in addition or alternatively to the above, the first mating end allows for mating with a second mating end of another one of the wireless power connector.

According to an advantageous embodiment of the invention which can be used in addition or alternatively to the above, the wireless power connector further comprises a receiving circuit 1130 for processing and outputting the received electric power at a predetermined voltage or current level.

According to another aspect of the invention, a wireless power connector system is provided. The wireless power connector system includes at least one of the previously described wireless power connector 1100, a second connector 1200 and a third connector 1300.

The second connector 1200 contactlessly supplies electric power to the at least one wireless power connector, and includes a magnetic core 1210 and a coil 1220 wound around the magnetic core, the coil serving as an electric power input for inputting an alternating current. The third connector 1300 contactlessly receives electric power from the at least one wireless power connector, and includes a magnetic core 1310 and a coil 1320 wound around the magnetic core and serving as an electric power output for outputting an alternating current.

When the second and the third connectors are respectively connected to the first and the second mating end of the at least one wireless power connector the magnetic core of the second connector, the magnetic core(s) of the at least one wireless power connector and the magnetic core of the third connector form a closed magnetic loop. In case of a plurality of interconnected wireless power connectors, when the second and the third connectors are respectively connected to the first and the second mating end of the plurality of interconnected wireless power connectors, the magnetic cores of the plurality of wireless power connector and the magnetic core of the third connector form a closed magnetic loop.

According to a further aspect of the invention, another wireless power connector system is provided. The Wireless power connector system includes at least one of the previously described wireless power connector 1100; a second connector 1200 and a terminating end 3400.

The second connector 1200 contactlessly supplies electric power to the at least one wireless power connector, and includes a magnetic core 1210 and a coil 1220 wound around the magnetic core, the coil serving as an electric power input for inputting an alternating current. The terminating element 3400 includes a magnetic core 3410.

When the second connector and the terminating element are respectively connected to the first and the second mating end of the at least one wireless power connector, the magnetic core of the second connector, the magnetic core(s) of the at least one wireless power connector and the magnetic core of the terminating element form a closed magnetic loop. In case of a plurality of interconnected wireless power connectors, when the second connector and the terminating element are respectively connected to the first and the second mating end of the plurality of interconnected wireless power connectors, the magnetic core of the second connector, the magnetic cores of the plurality of interconnected wireless power connectors and the magnetic core of the terminating element form a closed magnetic loop.

According to an advantageous embodiment of the invention which can be used in addition or alternatively to the above, the cross-sections of the magnetic core(s) of the at least one wireless power connector at the first and second mating end, correspond to the cross-sections of the magnetic cores of the second and third connector at their respective facing ends.

According to an advantageous embodiment of the invention which can be used in addition or alternatively to the above, the cross-sections of the magnetic core(s) of the at least one wireless power connector at the first and second mating end, correspond to the cross-sections of the magnetic cores of the second connector and of the terminating element at their respective facing ends.

According to an advantageous embodiment of the invention which can be used in addition or alternatively to the above, the magnetic core(s) of the at least one wireless power connector abuts the respective magnetic cores of the second and third connector or of the second connector and the terminating element at the first and second mating end, when the second and third connector or the second connector and the terminating element are respectively connected to the first and the second mating end of the at least one wireless power connector.

BRIEF DESCRIPTION OF THE DRAWINGS

The accompanying drawings are incorporated into the specification and form a part of the specification to illustrate several embodiments of the present invention. These drawings, together with a description, serve to explain the principles of the invention. The drawings are merely for the purpose of illustrating the preferred and alternative examples of how the invention can be made and used, and are not to be construed as limiting the invention to only the illustrated and described embodiments. Furthermore, several aspects of the embodiments may form—individually or in different combinations—solutions according to the present invention. Further features and advantages will be become apparent from the following more particular description of the various embodiments of the invention as illustrated in the accompanying drawings, in which like references refer to like elements, and wherein.

DETAILED DESCRIPTION

Figure 1A:
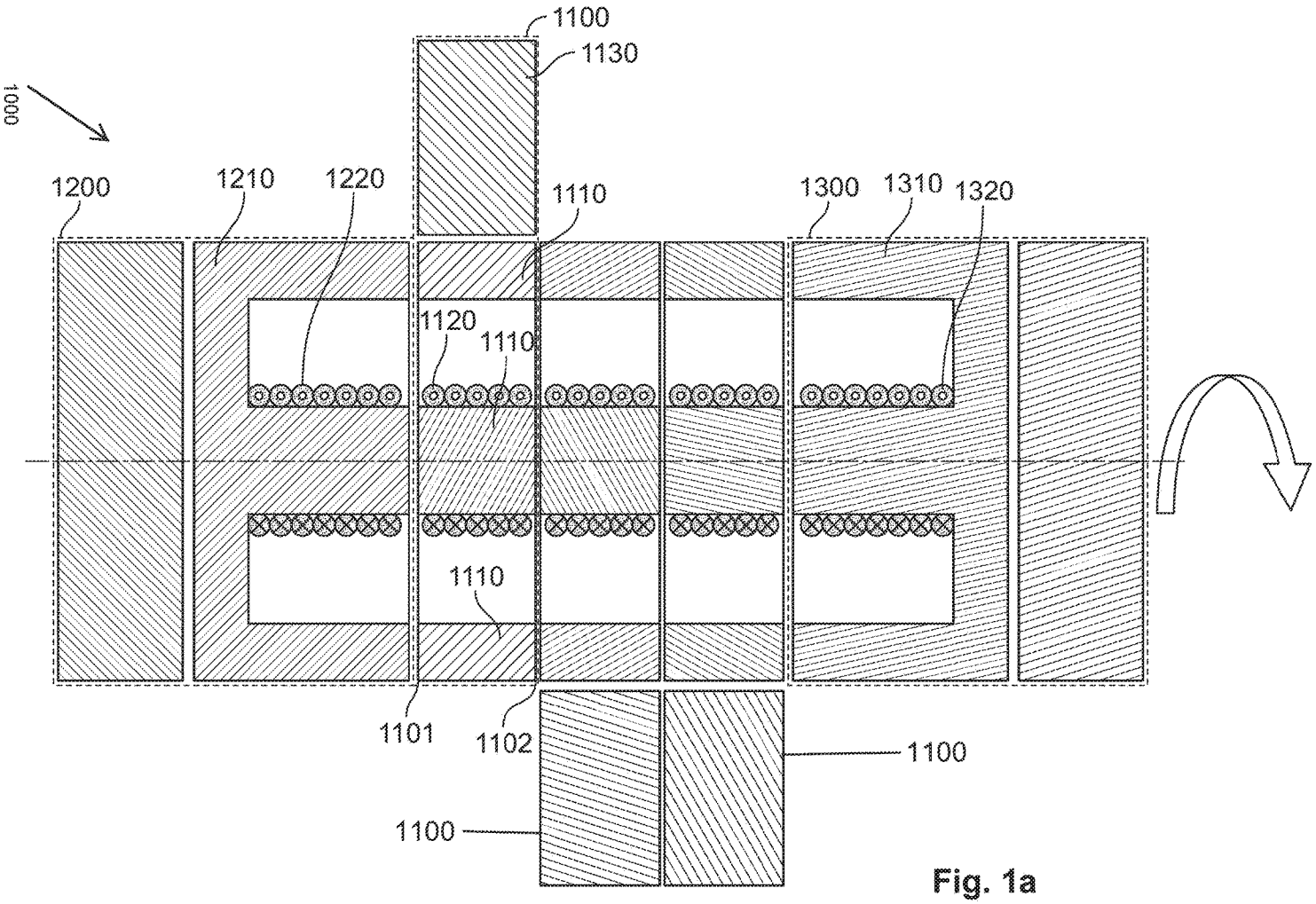
FIGS. 1*a*, 1*b* and 1*c* schematically shows a cross-section of an wireless power connector system, a detailed view showing the cross-section of an wireless power connector and a cross-section of the wireless power connector along the line A-A according to an exemplary embodiment of the invention.
Figure 1C:
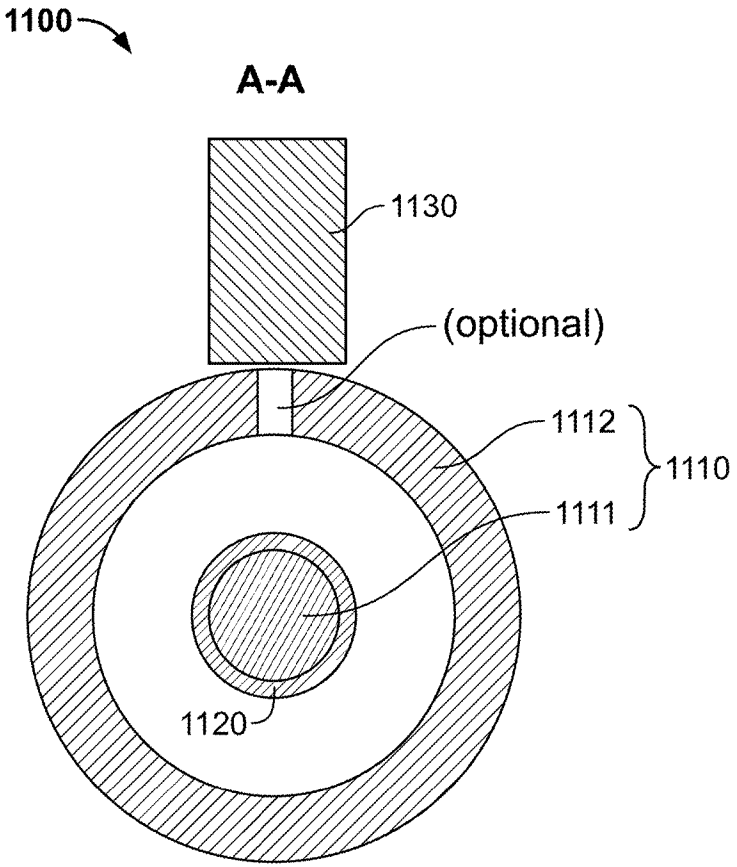
Figure 1B:
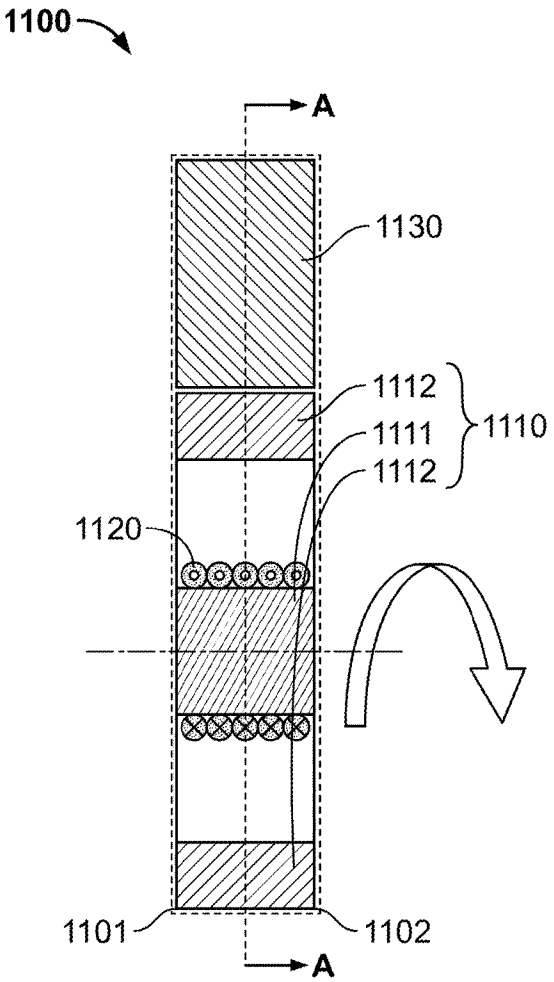

Referring to FIG. 1*a*, a cross-sectional view of a wireless power connector system according to an exemplary embodiment of the invention is shown. Further, FIG. 1*b* provides a detailed view of a wireless power connector according to the exemplary embodiment. FIG. 1*c* shows a cross-section of the wireless power connector of FIG. 1*b* along the line A-A.

In FIG. 1*a*, a wireless power connector system 1000 of this embodiment is illustrated. The wireless power connector system 1000 includes at least one first type wireless power connector 1100 (also named wireless power connector), a second type wireless power connector 1200 (also named second connector), and a third type wireless power connector 1300 (also named third connector).

As will become apparent from the discussion below, the second type wireless power connector 1200 is different from the third type wireless power connector 1300 and the wireless power connector is different from both the second type and the third type wireless power connector 1200, 1300. Specifically, FIG. 1*a* shows three interconnected wireless power connectors 1100.

In the wireless power connector system 1000 the second type wireless power connector 1200 is configured as a transmitting connector. In other words, the second type wireless power connector 1200 is configured to contactlessly supply electric power to a connected first type wireless power connector 1100. For this purpose, the second type wireless power connector 1200 includes a magnetic core 1210 and a coil 1220 wound around the magnetic core 1210. The coil 1220 serves as an electric power input for inputting an alternating current.

Further, in the wireless power connector system 1000 the third type wireless power connector 1300 is configured as receiving connector. In other words, the third type wireless power connector 1300 is configured to contactlessly receive electric power from a connected first type wireless power connector 1100. The third type wireless power connector 1300 may optionally also be configured to contactlessly receive electric power from a connected second type wireless power connector 1200, however, such a configuration is not considered in the following description. The third type wireless power connector 1300 includes a magnetic core 1310 and a coil 1320 wound around the magnetic core 1310. The coil 1320 serves as an electric power output for outputting an alternating current.

The first type wireless power connector 1100 of the wireless power connector system 1000 will be described in more detail with respect to FIGS. 1*b* and 1*c*. Nevertheless, from FIG. 1*a* it can be readily appreciated that the first type wireless power connector 1100 is connectable to the second type and to the third type of wireless power connector 1200, 1300 of the wireless power connector system 1000.

For this purpose, the first type wireless power connector 1100 includes a first and a second mating end 1101, 1102. As shown in FIG. 1*a*, the first mating end 1101 of the first type wireless power connector 1100 allows for mating with a second type wireless power connector 1200, and the second mating end 1102 of the first type wireless power connector 1100 allows for mating with a third type wireless power connector 1300.

As shown in FIG. 1*a*, the first and second mating end 1101, 1102 of the first type wireless power connector 1100 of the exemplary embodiment also allows for interconnecting a plurality of the wireless power connectors 1100. Put it differently, the second mating end 1102 of the first type wireless power connector 1100 allows for mating with the first mating end 1101 of another one of the first type wireless power connector 1100. Thereby, not only a single first type wireless power connector 1100 can be connected in-between the second type and the third type wireless power connectors 1200, 1300, but the wireless power connector system 1000 can also be extended so as to include a plurality of (stacked) first type wireless power connectors 1100 as shown in FIG. 1*a*.

According to an exemplary implementation, the first and/or second mating end(s) 1101, 1102 of the first type wireless power connector 1100 may be configured to allow for mating with only the respective second and/or third type wireless power connector 1200, 1300. Thereby, a non-operational assembly of the wireless power connector system 1000 is prevented, e.g. with two third type wireless power connectors 1300 or with two second type wireless power connectors 1200.

Alternatively, according to another exemplary implementation, the first and second mating ends 1101, 1102 of the first type wireless power connector 1100 may also be configured to allow for mating with any of the second type and third type wireless power connectors 1200, 1300. Thereby, an easy assembly of the wireless power connector system can be ensured; however, it may become necessary to additionally include electronic circuitry within each wireless power connector to detect a non-operational assembly of the wireless power connector system.

The wireless power connector system 1000 of this embodiment may be used for power transmissions of up to 12 Watts from the second type wireless power connector 1200 via at least one of the first type wireless power connector 1100 to the third type wireless power connector 1300. In this respect, the second type wireless power connector 1200 acts as transmitting connector for contactlessly transmitting electric energy. The third type wireless power connector 1300 acts as receiving connector for contactlessly receiving electric energy.

As will be explained in more detail below, the first type wireless power connector 1100 is configured to contactlessly receive and to contactlessly forward electric energy at the same time. The electric energy is contactlessly forwarded by the first type wireless power connector via inductive coupling to the third type wireless power connector. Accordingly, the first type wireless power connector 1100 relays, in a mated state with the second and third type wireless power connector 1200, 1300, at least parts of the electric power received from the second type wireless power connector 1200 to the third type wireless power connector 1300.

In other words, the first type wireless power connector 1100 is configured to inductively forward energy such that the contactless transmitted electric power from the second type wireless power connector 1200 can not only be received by the first type connected wireless power connector 1100 itself but can also be received by a connected third type wireless power connector 1300.

Consequently, the wireless power connector system 1000, according to the exemplary embodiment shown in FIG. 1*a*, may be utilized for power transmissions from a single transmitting connector (e.g. the second type wireless power connector 1200) to a plurality of receiving connectors (e.g. the first type wireless power connector 1100 and/or the third type wireless power connector 1300). The wireless power connector system 1000 of this embodiment overcomes the restriction to a 1:1 relationship between a transmitting connector and a receiving connector.

Referring now to FIG. 1*b*, the first type wireless power connector 1100 of the embodiment is shown in a detailed view. The first type wireless power connector 1100 is configured to output at least parts of the electric power received from a connected second type wireless power connector 1200 and to inductively forward at least parts of the received electric power to another connected connector.

The other connected connector may be one of: a first type wireless power connector 1100, a third type wireless power connector 1300 or a terminator element 3100. For this purpose, the first type wireless power connector 1100 includes a first and a second mating end 1101, 1102.

As explained earlier, the first mating end 1101 of the first type wireless power connector 1100 allows for mating with a second type wireless power connector 1200, the second type wireless power connector 1200 being configured to contactlessly supply electric power. The second mating end 1102 of the first type wireless power connector 1100 allows for mating with a third type wireless power connector 1300, the third type wireless power connector 1300 being configured to contactlessly receive electric power.

Specifically, the first type wireless power connector 1100 includes a magnetic core 1110 formed between the first and the second mating end 1101, 1102. In other words, a magnetic core 1110 is arranged in the first type wireless power connector 1100 extending between the first and the second mating end 1101, 1102. Exemplary, the magnetic core 1110 may be provided of ferromagnetic metals like iron, or other ferromagnetic compounds, or ferrite materials.

According to an exemplary implementation, the magnetic core 1110 is arranged in the first type wireless power connector 1100 extending between the surface of the first mating end 1101 and the surface of the second mating end 1102 of the first type wireless power connector 1100. For protection reasons, the magnetic core 1110 may be covered by a thin cover layer. Preferably, the cover layer is realized of a non-metal and/or a not electrically-conducting material. Yet, the magnetic core 1110 is advantageously arranged within the first type wireless power connector 1100 at close proximity of the surface of the first and of the second mating end 1101, 1102.

According to another exemplary implementation, the magnetic core 1110 is arranged in the first type wireless power connector 1100 such that the magnetic core 1110 is exposed at the first and at the second mating end 1101, 1102. Specifically, the magnetic core 1100 may be arranged such that its surface area is flush (planar) with the surface of first mating end 1101 and with the surface area of the second mating end 1102 of the first type wireless power connector 1100.

This exemplary implementation of the magnetic core 1110 of the first type wireless power connector 1100 allows for a connection to the second and third type wireless power connector 1200, 1300 where the magnetic core 1110 abuts the respective magnetic cores 1210, 1310 of the second type and third type wireless power connector 1200, 1300.

Due to the magnetic core 1110 of the first type wireless power connector 1100 (directly) interconnecting the first and the second mating end 1101, 1102, the magnetic core 1110 inductively forwards electric power received from a connected second type wireless power connector 1200 to a connected third type wireless power connector 1300.

In other words, the magnetic core 1110 of the first type wireless power connector 1100 guides magnetic flux supplied from a connected second type wireless power connector 1200 to a connected third type wireless power connector 1300 and, hence, reduces magnetic losses compared to a same spatial arrangement between second type and third type wireless power connector 1200, 1300 without the intermediate first type wireless power connector 1100.

The first type wireless power connector 1100 additionally includes a coil 1120 wound around the magnetic core 1110 and configured as a power output for outputting at least parts of the electric power received from the second type wireless power connector 1200. The received electric power is output by the coil 1120 of the first type wireless power connector 1100 as alternating current.

Specifically, the coil 1120 of the first type wireless power connector 1100 includes a predefined number of loops of an insulated conductor such as e.g. a coated solid copper wire. Among other factors, the inductive coupling between the coil 1120 and the magnetic core 1110 determines the amount of electrical power output by the first type wireless power connector 1100.

Referring now to FIG. 1*c*, a cross-section of the first type wireless power connector 1100 of FIG. 1*a* along the line A-A is shown. As can be seen, the magnetic core 1110 of the first type wireless power connector 1100 includes a first leg 1111 and a second leg 1112.

In general, a first and the second leg 1111, 1112 of the magnetic core 1110 of the first type wireless power connector 1100 respectively interconnect first and second regions of the first and the second mating end 1101, 1102 of the first type wireless power connector 1100 such that, when the first type wireless power connector 1100 is connected to a second type wireless power connector 1200 and to a third type wireless power connector 1300, the magnetic cores of all connectors form a closed magnetic loop.

Specifically, when the second and the third type wireless power connector 1200, 1300 are respectively connected to the first and the second mating end 1101, 1102 of the at least one first type wireless power connector 1100 which, in case of a plurality of first type wireless power connectors 1100, is formed of the plurality of interconnected first type wireless power connectors 1100, the magnetic core of the second type wireless power connector 1200, the magnetic core(s) of the at least one first type wireless power connector 1100 and the magnetic core of the third type wireless power connector 1300 form a closed magnetic loop.

In the wireless power connector system 1000, a closed magnetic loop improves the magnetic coupling between the second type wireless power connector 1200, the at least one first type wireless power connector 1100 and the third type wireless power connector 1300 and allows for highly efficient contactless electric power transmissions from the second type wireless power connector 1200 via the at least one first type wireless power connector 1100 to the third type wireless power connector 1300.

In an exemplary embodiment of the first type wireless power connector 1100, the magnetic core 1110 is configured such that the first leg 1111 is provided at a center of the surface of the first and second mating ends 1101, 1102 and the second leg 1112 of the first type wireless power connector 1100 at least partially surrounds at the surface of the first and second mating ends 1101, 1102 the first leg 1111 at a predefined distance.

With respect to the previous terminology of a first and second region of the first and second mating end 1101, 1102 being interconnected by the first and the second leg 1111, 1112 of the magnetic core 1110, in the first type wireless power connector 1100 shown in FIG. 1*c* the first region of the first and the second mating end 1101, 1102 corresponding to the first leg 1111 of the magnetic core 1110 is a region at the center of the surface of the first and the second mating end 1101, 1102; and the second region of the first and the second mating end 1101, 1102 corresponding to the second leg 1112 of the magnetic core 1110 is a loop-shaped region (at a predefined distance around the center) of the surface of the first and the second mating end 1101, 1102.

Due to this rotationally symmetric arrangement of first and second region of the corresponding first and second legs 1111, 1112 of the magnetic core 1110, the first type wireless power connector 1100 allows for a rotatable connection with the second and the third type first type wireless power connector 1200, 1300 with respect to a center axis (rotational axis) of the first type wireless power connector 1100. Needless to say that the first and the second mating ends of the first type wireless power connector are also adapted to allow for a rotatable connection to the second and the third type wireless power connector 1200, 1300.

In more detail, the first leg 1111 of the magnetic core 1110 is provided with a circular cross-section, and the second leg 1112 of the magnetic core 1110 is provided with a C-shape cross-section. The second leg 1112 may be provided by removing a small portion (circle segment) from an O-shaped (tubular) second leg 1112 to form the C-shaped cross-section of the second leg 1112. The portion (circle segment) is small in comparison to the perimeter of the second leg 1112, and may exemplary correspond to an opening of up to 3 mm.

Alternatively, the tubular second leg 1112 may also be provided with an opening, exemplary in shape of a hole, so as to allow for an interconnection between the inside and the outside of the second leg 1112.

Specifically, the opening within the tubular second leg 1112 allows for an external connection of coil 1120. In other words, the tubular second leg 1112 of the magnetic core 1110 is formed with a recess such that the coil 1120 wound around the first leg 1111 inside of second leg 1112 can be connected to a receiving circuit arranged outside of the second leg 1112.

The first type wireless power connector 1100 also includes a receiving circuit 1130 for processing and outputting the received electric power at a predetermined voltage or current level. The receiving circuit 1130 is an electric circuit connected to coil 1110 and is configured to transform the received electrical power outputted by the coil 1110 as an alternating current into a predetermined voltage or current level. The predetermined voltage or current level to be output by the receiving circuit 1130 may be a maximum/RMS/mean voltage or current level or may be a constant voltage or current level.

In general it can be readily appreciated that the efficiency of the electric power transmittal within the wireless power connector system 1000 is highest when, at the first and second mating end, the cross-sections of the magnetic core 1110 of the at least one first type wireless power connector 1100 corresponds to the cross-sections of the magnetic cores 1210, 1310 of the second type and third type wireless power connector 1200, 1300 at their respective facing ends.

Figure 2:
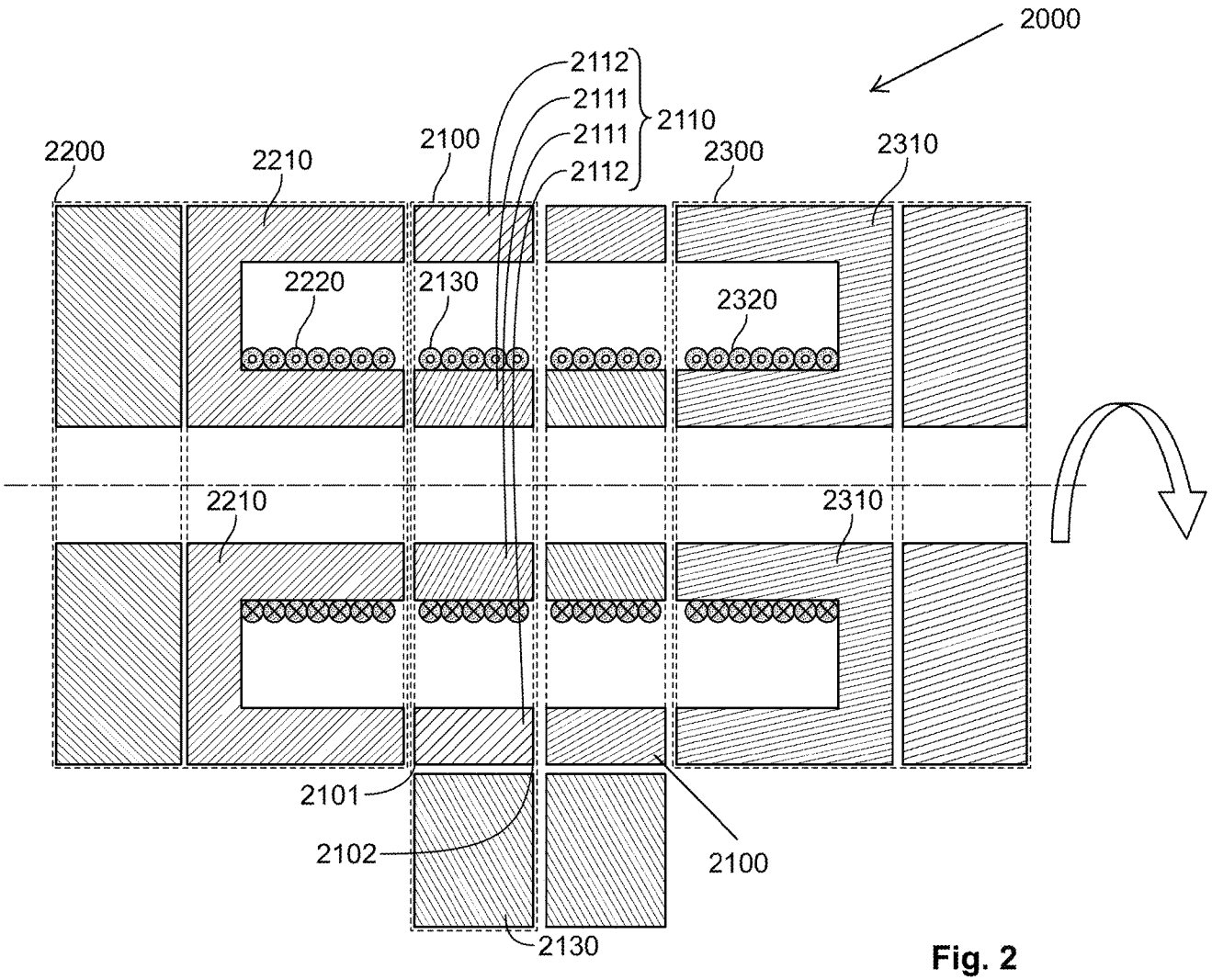
FIG. 2 schematically shows a cross-section of a wireless power connector system according to another exemplary embodiment of the invention, FIG. 3 schematically shows a cross-section of a wireless power connector system according to further exemplary embodiment of the invention, and FIG. 4 schematically shows a wireless power connection.

Referring now to FIG. 2, a wireless power connector system 1000 according to another exemplary embodiment of the invention is shown including a corresponding first type wireless power connector 2100 connected to a second type wireless power connector 2200 and a third type wireless power connector 2300.

FIG. 2 is a cross-section of a wireless power connector system 2000 of the exemplary embodiment of the invention. The wireless power connector system 2000 as well as the first type wireless power connector 2100 is based on respective wireless power connector system 1000 and the first type wireless power connector 1100 of FIGS. 1*a*, 1*b* and 1*c* where corresponding parts are given corresponding reference numerals and terms. The detailed description of corresponding parts has been omitted for reasons of conciseness.

In particular, the first type wireless power connector 2100 of the wireless power connector system 2000 differs from the first type wireless power connector 1100 in that the magnetic core 2110 included in the wireless power connector is hollow around a centre (rotational) axis.

This embodiment of the wireless power connector 2100 allows for an opening at the centre (rotational) axis of the wireless power connector 2100 for receiving a drive shaft so as to facilitate usage of the wireless power connector 2100.

In more detail, the magnetic core 2110 of the first type wireless power connector 2100 includes a first leg 2111 and a second leg 2112 where the first leg 2111 of the magnetic core 2110 is provided with a tubular cross-section (i.e. with an opening at the centre axis), and the second leg 2112 of the magnetic core 2110 is provided with a C-shape cross-section.

Exemplary, the second leg 2112 may be provided by removing a small circular segment from an O-shaped (tubular) second leg 2112 to form the C-shaped cross-section of the second leg 2112. The removed circular segment is small in comparison to the perimeter of the second leg 2112, and may exemplary correspond to an opening of up to 3 mm.

Also in this embodiment, it is advantageous for the efficiency of the wireless power connector system 2000 when, at the first and second mating end, the cross-sections of the magnetic core 2110 of the at least one first type wireless power connector 2100 corresponds to the cross-sections of the magnetic cores 2210, 2310 of the second type and third type wireless power connector 2200, 2300 at their respective facing ends.

Specifically, when the second and the third type wireless power connector 2200, 2300 are respectively connected to the first and the second mating end 2101, 2102 of the at least one first type wireless power connector 2100 which, in case of a plurality of first type wireless power connectors, is formed of the plurality of interconnected first type wireless power connectors, the magnetic core 2210 of the second type wireless power connector 2200, the magnetic core(s) 2110 of the at least one first type wireless power connector(s) 2100 and the magnetic core 2310 of the third type wireless power connector 2300 form a closed magnetic loop.

Figure 3:
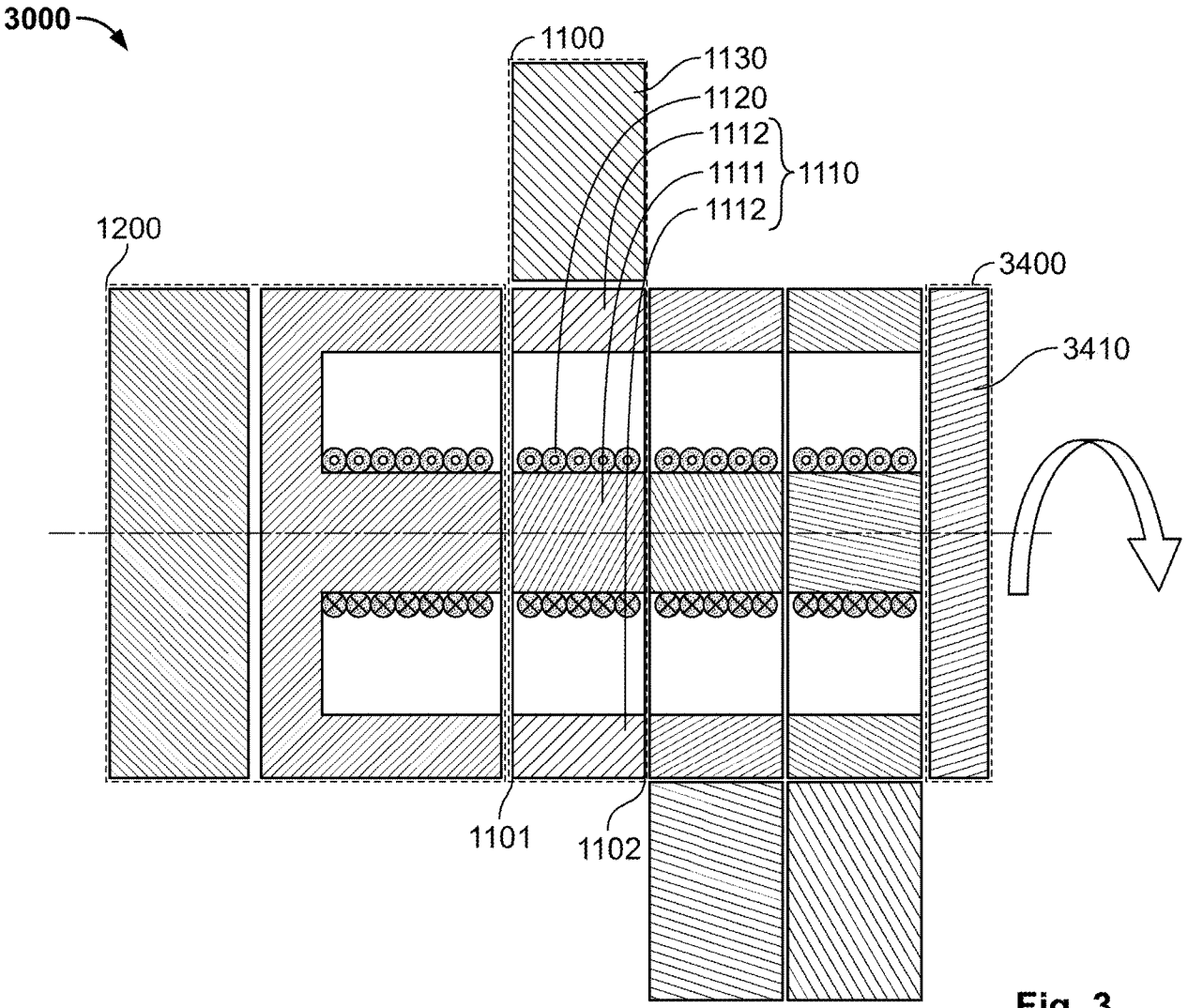
Figure 4:
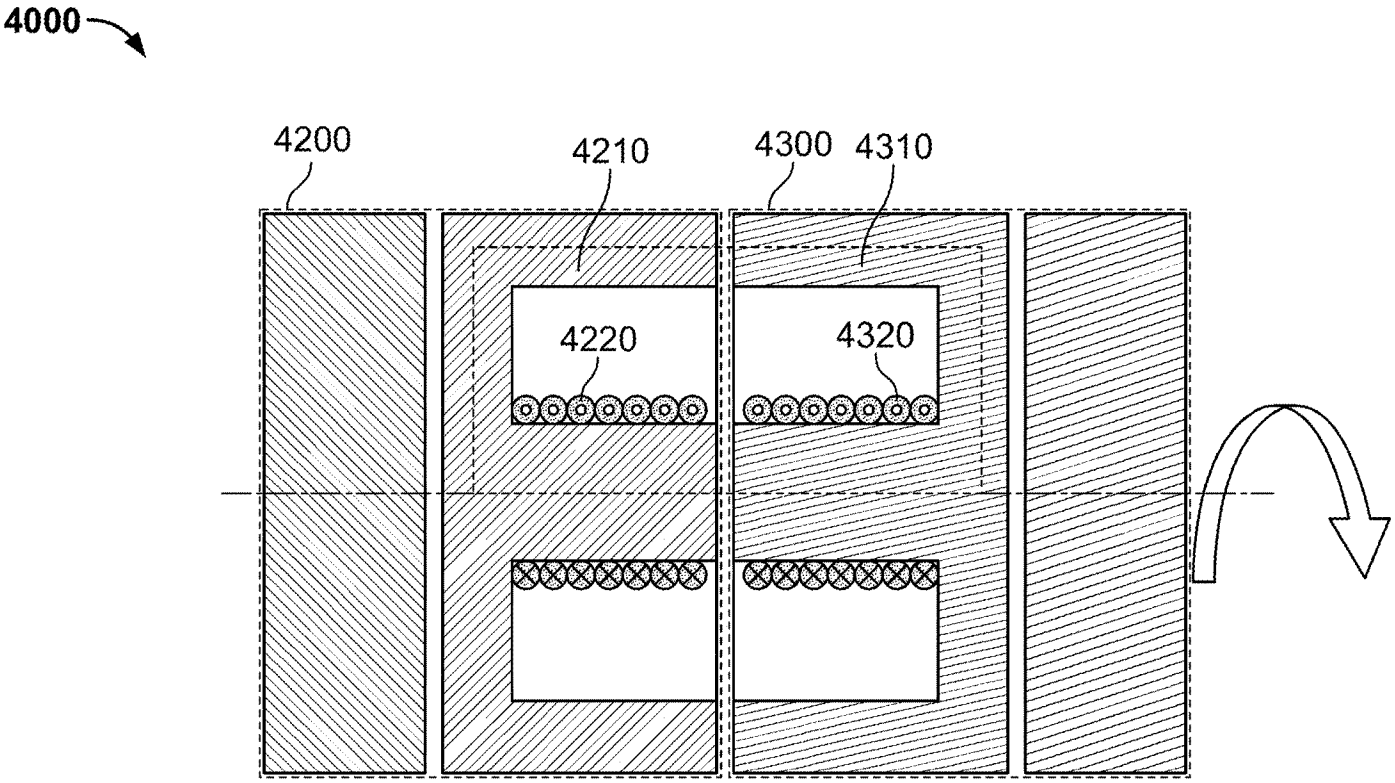
Fig. 4 (Prior Art)

Referring now to FIG. 3, a wireless power connector system 3000 according to another exemplary embodiment of the invention is shown including a corresponding first type wireless power connector 1100 connected to a second type wireless power connector 1200 and a terminating element 3400.

FIG. 3*a* is a cross-section of a wireless power connector system 3000 of the exemplary embodiment of the invention. The wireless power connector system 3000 is based on respective wireless power connector system 1000 of FIGS. 1*a*, 1*b* and 1*c* where corresponding parts are given corresponding reference numerals and terms. The detailed description of corresponding parts has been omitted for reasons of conciseness.

In particular, the first type wireless power connector system 2100 differs from the first type wireless power connector system 1000 in that the first type wireless power connector 1100 is connected to a terminating element 3400 instead of a third type wireless power connector 1200.

The terminating element 3400 includes a magnetic core 3410. At the second mating end 1102, the cross-sections of the magnetic core 1110 of the first type wireless power connector 1100 corresponds to the cross-sections of the magnetic core 3410 of the terminating element 3400 at its respective facing end.

Further, when the second type wireless power connector 1200 and the terminating element 3400 are respectively connected to the first and the second mating end 1101, 1102 of the at least one first type wireless power connector 1100 which, in case of a plurality of first type wireless power connectors, is formed of the plurality of interconnected first type wireless power connectors, the magnetic core 1210 of the second type wireless power connector 1200, the magnetic core(s) 1110 of the at least one first type wireless power connector 1100 and the magnetic core 3410 of the terminating element 3400 form a closed magnetic loop.

REFERENCES

| Reference Numerals | Description |
|---|---|
| 1000, 2000, 3000, 4000 | Wireless power connector system |
| 1100, 2100 | Wireless power connector |
| 1101, 2101 | First mating end |
| 1102, 2102 | Second mating end |
| 1110, 2110 | Magnetic core |
| 1111, 2111 | First leg of magnetic core |
| 1112, 2112 | Second leg of magnetic core |
| 1120, 2120 | Coil |
| 1130, 2130 | Receiving circuit |
| 1200, 2200 | First type wireless power connector |
| 1210, 2210 | Magnetic core |
| 1220, 2220 | Coil |
| 1300, 2300 | Second type wireless power connector |
| 1310, 2310 | Magnetic core |
| 1320, 2320 | Coil |
| 3400 | Terminating element |
| 3410 | Magnetic core |
| 4200 | Transmitting connector |
| 4210 | Magnetic core |
| 4220 | Coil |
| 4300 | Receiving connector |
| 4310 | Magnetic core |
| 4320 | Coil |

The invention claimed is:

1. A wireless power connector for contactlessly receiving electric power from a second connector and for contactlessly supplying electric power to a third connector, the wireless power connector comprising:

a first and a second mating end respectively connectable to the second and the third connector;

a magnetic core extending between the first and the second mating end;

a coil wound around the magnetic core and configured to output, as an alternating current, at least parts of the electric power received from the second connector; and a receiving circuit for processing and outputting the received electric power at a predetermined voltage or current level;

wherein the magnetic core interconnects the first and the second mating end such that, when the wireless power connector is connected to the second and to the third connector, the magnetic core inductively forwards at least parts of the electric power received from the second connector to the third connector.

2. The wireless power connector according to claim 1, wherein the magnetic core includes two legs respectively interconnecting first and second regions of the first and the second mating end.

3. The wireless power connector according to claim 1, wherein the magnetic core includes a first, cylindrical leg and a second, C-shaped or O-shaped leg at least partially surrounding the first leg, and the coil is wound around the first leg.

4. The wireless power connector according to claim 3, wherein the first leg of the magnetic core is hollow.

5. The wireless power connector according to claim 1, wherein the magnetic core extends between the surfaces of the first and the second mating end.

6. The wireless power connector according to claim 5, wherein the magnetic core includes exposed surface areas at the first and the second mating end of the wireless power connector.

7. The wireless power connector according to claim 1, wherein the second mating end is connectable to a terminating element including a magnetic core.

8. The wireless power connector according to claim 1, wherein the first and/or second mating end(s) allow for a rotatable connection to the second and the third connector.

9. The wireless power connector according to claim 1, wherein the first and/or second mating end(s) allow for mating with only the respective second and/or third connector, or the first and second mating ends allow for mating with any of the respective second and third connectors.

10. The wireless power connector according to claim 1, wherein the first mating end allows for mating with a second mating end of another one of the wireless power connector.

11. A wireless power connector system, comprising:

at least one wireless power connector according to claim 1;

a second connector for contactlessly supplying electric power to the at least one wireless power connector, the second connector including a magnetic core and a coil wound around the magnetic core, the coil serving as an electric power input for inputting an alternating current;

a terminating element including magnetic core; wherein when the second connector and the terminating element are respectively connected to the first and the second mating end of the at least one wireless power connector which, in case of a plurality of wireless power connectors, is formed of the plurality of interconnected wireless power connectors, the magnetic core of the second connector, the magnetic core(s) of the at least one wireless power connector and the magnetic core of the terminating element form a closed magnetic loop.

12. A wireless power connector system, according to claim 11, wherein, at the first and second mating end, the cross-sections of the magnetic core(s) of the at least one wireless power connector correspond to the cross-sections of the magnetic cores of the second and third connector at their respective facing ends, or at the first and second mating end, the cross-sections of the magnetic core(s) of the at least one wireless power connector correspond to the cross-sections of the magnetic cores of the second connector and of the terminating element at their respective facing ends.

13. The wireless power connector system, according to claim 11, wherein the magnetic core(s) of the at least one wireless power connector abuts the respective magnetic cores of the second and third connector or of the second connector and the terminating element at the first and second mating end, when the second and third connector or the second connector and the terminating element are respectively connected to the first and the second mating end of the at least one wireless power connector.

14. A wireless power connector for contactlessly receiving electric power from a second connector and for contactlessly supplying electric power to a third connector, the wireless power connector comprising:

a first and a second mating end respectively connectable to the second and the third connector;

a magnetic core extends between the first and the second mating end;

a coil wound around the magnetic core and configured to output, as an alternating current, at least parts of the electric power received from the second connector; and wherein the magnetic core interconnects the first and the second mating end such that, when the wireless power connector is connected to the second and to the third connector, the magnetic core inductively forwards at least parts of the electric power received from the second connector to the third connector and wherein the first and/or second mating end(s) allow for a rotatable connection to the second and the third connector.

15. A wireless power connector for contactlessly receiving electric power from a second connector and for contactlessly supplying electric power to a third connector, the wireless power connector comprising:

a first and a second mating end respectively connectable to the second and the third connector;

a magnetic core extends between the first and the second mating end;

a coil wound around the magnetic core and configured to output, as an alternating current, at least parts of the electric power received from the second connector; and wherein the magnetic core interconnects the first and the second mating end such that, when the wireless power connector is connected to the second and to the third connector, the magnetic core inductively forwards at least parts of the electric power received from the second connector to the third connector and wherein the first mating end allows for mating with a second mating end of another one of the wireless power connector.

* * * * *